United States Patent [19]

Hamar

[11] 4,205,722

[45] Jun. 3, 1980

[54] PUMP SUPPORT ADAPTER

[76] Inventor: James H. Hamar, 3454 SE. Francis St., Portland, Oreg. 97202

[21] Appl. No.: 932,715

[22] Filed: Aug. 11, 1978

[51] Int. Cl.[2] ..... E21B 33/03

[52] U.S. Cl. ..... 166/95; 166/88

[58] Field of Search ..... 166/95, 88

[56] References Cited

U.S. PATENT DOCUMENTS

| | | | |
|---|---|---|---|
| 1,512,619 | 10/1924 | MacClatchie | 166/95 |
| 1,536,680 | 5/1925 | McLaine et al. | 166/88 |
| 2,771,955 | 11/1956 | Carter | 166/88 |
| 2,946,386 | 7/1960 | Jones | 166/95 |
| 3,568,769 | 3/1971 | Maass | 166/88 |
| 3,797,571 | 3/1974 | Hamar | 166/88 |

*Primary Examiner*—James A. Leppink

*Attorney, Agent, or Firm*—Eugene M. Eckelman

[57] ABSTRACT

A support head for sealing the top of a cylindrical well casing and also for supporting a vertical well pipe and pump in suspended relation in a well. The head has a top surface and also a downwardly facing surface to engage the top edge of the well casing in a sealing support. A vertical opening is provided in the head to slidably receive the well pipe, and a seal is provided around the vertical opening so as to engage the vertical well pipe and be sealed by a fitting on the pipe by the weight of the suspended well pipe and pump. The seal between the head and the well pipe comprises a compressible sealing gasket in an annular recess also operable in sealing relation by the weight of the suspended pipe and pump.

1 Claim, 5 Drawing Figures

PUMP SUPPORT ADAPTER

BACKGROUND OF THE INVENTION

This invention relates to new and useful improvements in pump support adapters.

In my prior U.S. Pat. No. 3,797,571 I have shown a pump support adapter including a housing with threaded portions for receiving a pipe to be suspended in the well. The housing has side and top outlets for receiving discharge conduits or the like and such housing also has a bottom shoulder associated with an annular sealing flange and gasket, the gasket engaging the top of the well casing and serving the improved purpose of sealing the top of the well casing.

SUMMARY OF THE INVENTION

According to the present invention and forming a primary objective thereof, a pump support adapter is provided that has greater simplicity than that shown in my prior patent and a structure also that in particular applications serves effectively to seal the top of a well casing. The adapter at the same time supports a well pipe and pump in suspended relation.

In carrying out the invention, a support head is provided having a gasketed sealed connection with the top edge of a well casing. Such sealed connection is accomplished by the hanging weight of a well pipe assembly. The head has a vertical opening therethrough and an annular recess on its upper surface around such opening for receiving a sealing gasket. The top end of the well pipe is provided with a fitting or an enlargement, such as a cross fitting, which is arranged to operably engage the sealing gasket and compress it radially into a positive sealed engagement between the head and the well pipe by the hanging weight of the well pipe assembly.

The invention will be better understood and additional objects and advantages will become apparent from the following description taken in connection with the accompanying drawings which illustrate a preferred form of the device.

DETAILED DESCRIPTION OF A PREFERRED EMBODIMENT

Figure 2:
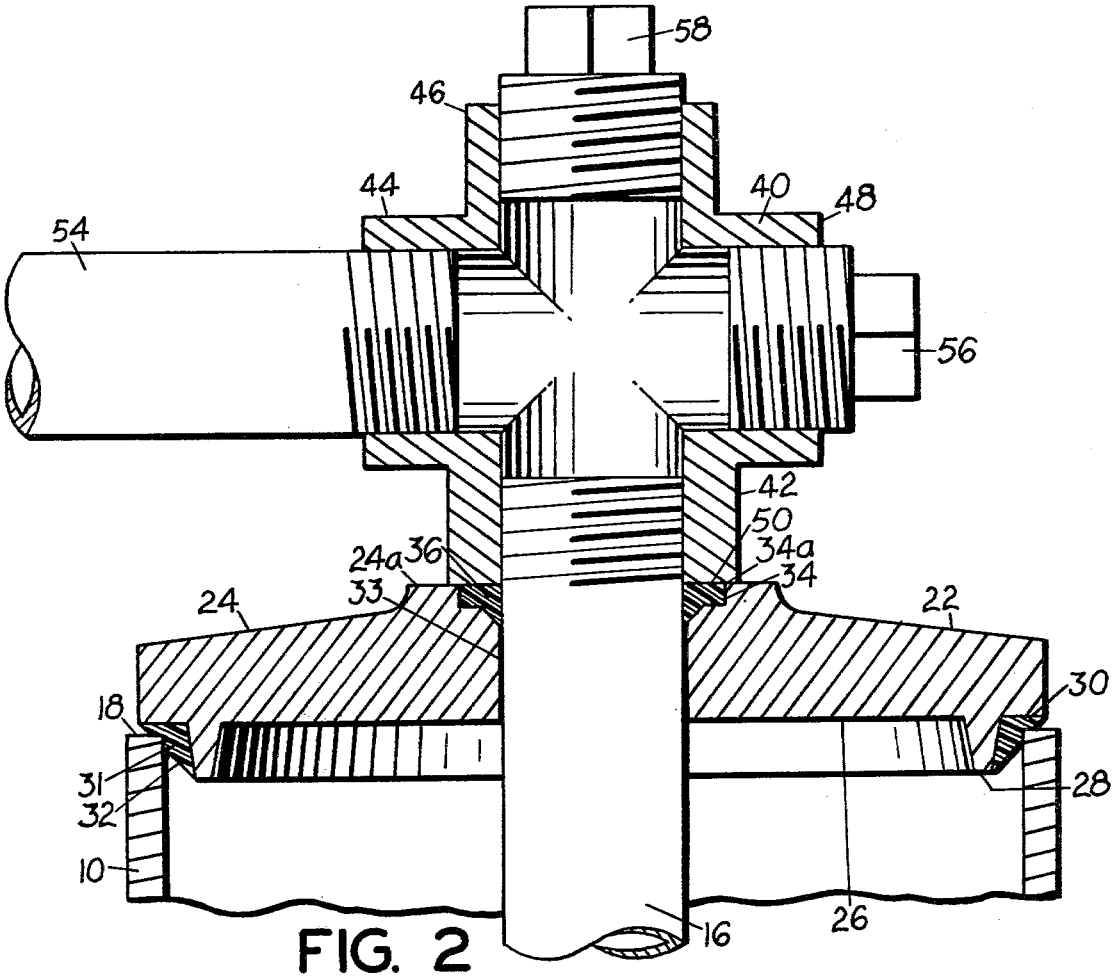
FIG. 2 is an enlarged sectional view of the adapter and a well casing showing sealing means in their sealing condition.
Figure 1:
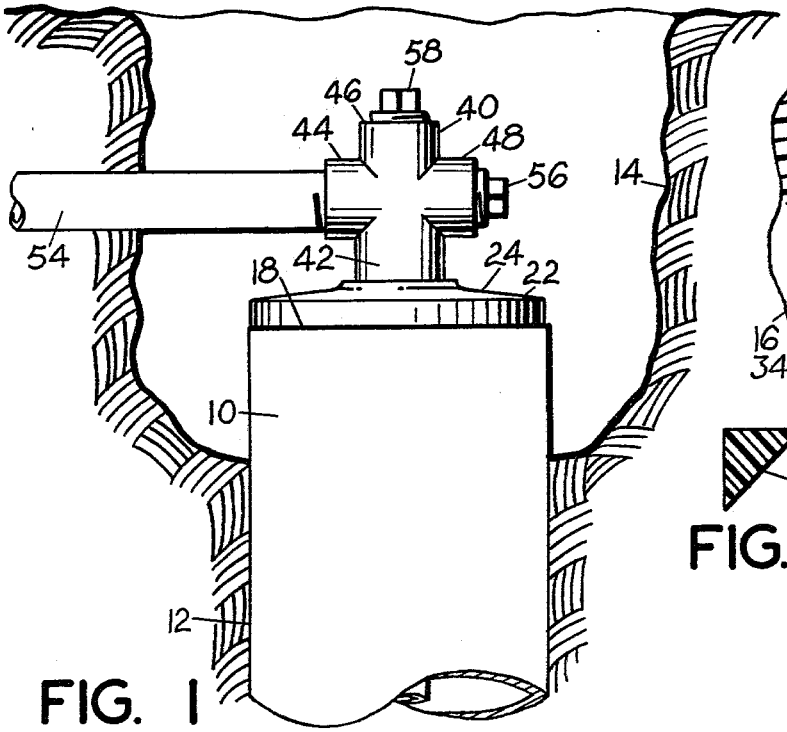
FIG. 1 is an elevational view of a pump support adapter embodying the invention, the adapter being shown in place on a well casing and disposed in a pit in a usual installation.

FIG. 1 shows a typical installation of a casing 10 inserted in a well hole 12 drilled in the ground. Frequently the casing is set down in a pit 14 excavated in the ground. With reference to FIG. 2 a vertical well pipe 16 extends down through the casing 10 and supports a pump, not shown, in suspended relation submerged in the fluid to be pumped up through the pipe. The well casing 12 has a top edge 18.

According to the present invention, a head 22 of somewhat plate-like form has a top surface 24 and a bottom surface 26. Surface 24 includes a flat central or boss portion **24*a*. An annular flange or skirt 28 depends from the bottom surface 26 inwardly of the outer edge of the head, and the area 30 of the bottom surface outside of the flange 28 provides a seating support for the head on the top edge 18 of the well casing 10. An annular gasket 31 is provided between the surface 30 and the top of the well casing. This gasket has an outer surface 32 angled inwardly from top to bottom to provide a good sealed joint. The weight of the head 22 and the hanging weight of the well pipe 16 and pump provides a positive sealed engagement between the head and the well casing. The gasket 31** is formed of a resilient material to form a seal, and due to such resilience, a good seal will be maintained even though the well pipe may hang a little crooked relative to the casing.

The support head 22 has a central opening or bore 33 which is the same shape as the well pipe 16. The bore 33 is slightly larger than pipe 16 to allow the latter to be inserted and removed freely and also to allow the pipe to adjust its hanging position in the well.

Figure 3:
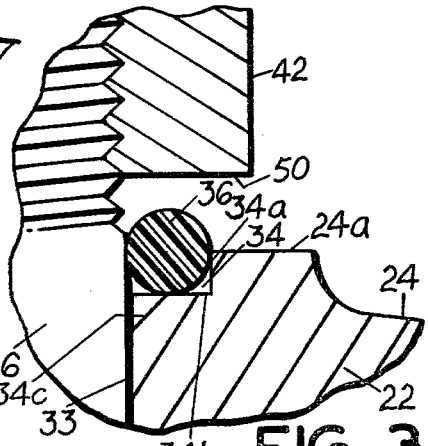
FIG. 3 is an enlarged fragmentary sectional view showing a position of a sealing gasket prior to a compressed sealing condition of said gasket.

An annular recess 34 is provided in the flat top area **24*a* around the opening 33, and such recess has an outer vertical defining wall portion 34*a*, FIG. 3, a horizontal wall portion 34*b* leading a part of the distance between the wall portion 34*a* and the opening 33, and a downwardly inclined wall portion 34*c* leading from the inner end of horizontal wall portion 34*b* to the opening 33**.

Recess 34 is arranged to receive a sealing gasket 36 of resilient, compressible material such as rubber or a durable plastic. The over-all cross sectional area of the sealing gasket 36 is greater than the over-all cross sectional area of the recess 34 so that when such gasket is compressed into the recess from the top it will at least fill the recess and be expanded radially into firm sealing engagement with the well pipe 16. FIG. 3 shows the condition of the gasket 36 prior to compression thereof and FIG. 2 shows the gasket in compressed, sealing condition.

A fitting 40 is provided on the upper end of well pipe 16 and may for example comprise a conventional cross connector having internally threaded extensions 42, 44, 46, and 48. The extension 42 is arranged to receive a threaded portion of well pipe 16 in an arrangement to provide a support for the depending pipe and pump thereon. The bottom edge 50 of the extension 42 is flat and operably engages the sealing gasket 36 to compress it to its sealing condition in the recess by the hanging weight of the well pipe assembly.

Extensions 44, 46 and 48 in the fitting 40 are utilized as necessary for connection to one or more outlet conduits 54 or to receive plugs 56 when that particular extension is not needed. The top extension 46 may also be used for connection to lifting means, not shown, for raising and lowering the pipe assembly. At other times, extension 46 may be plugged by a plug 58.

In accordance with the invention, a good seal is provided for the top of a well casing, namely, by the gasketed engagement of the head 22 with the top edge 18 of such casing. As stated hereinbefore, a good seal is established even though the pipe 16 may hang a little crooked since the resilience of the gasket 31 maintains the seal even though the hanging pressure is not straight down. In fact, since the opening 33 through the head 22 is slightly larger than the well pipe, the well pipe can move or adjust angularly a slight amount without tilting the head 22. Since gasket 36 is larger in its over-all normal cross sectional area than the recess 34, a good compression seal is provided against the well pipe 16. The entire seal established between the top of the well casing and the head 22 and between the head and the well pipe 16 is accomplished by the hanging weight of the well pipe assembly.

Figure 4:
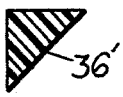
FIGS. 4 and 5 are cross sectional views of additional shapes of sealing gaskets that may be used.
Figure 5:
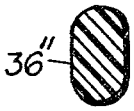

FIGS. 4 and 5 show triangular and oval cross-sectional shapes 36' and 36'' respectively, of the top sealing gasket to illustrate that cross-sectional shapes other than round may be used.

It is to be understood that the form of my invention herein shown and described is to be taken as a preferred example of the same and that various changes in the shape, size and arrangement of parts may be resorted to without departing from the spirit of my invention, or the scope of the subjoined claims. For example, the member 40 connected to the top of the well pipe 16 may take other forms. It may be other than a conventional cross fitting and be welded or otherwise secured to the top of the pipe, it only being necessary that it have an inlet communicating with the pipe 16 and one or more outlets, as well as a bottom surface or edge capable of causing the compression of sealing gasket 36.

Having thus described my invention, I claim:

1. A pump support adapter for sealing the top of a cylindrical well casing having an open top edge and also for supporting a vertical well pipe and pump in suspended relation in a well from such open top edge, comprising (a) a support head, (b) said head having a substantially flat top surface and also having a downwardly facing surface arranged to be supported on the top edge of a well casing, (c) first resilient annular sealing means on the downwardly facing surface of said head arranged for engagement with the top edge of a well casing, (d) means defining a vertical inlet opening in said head arranged freely to receive a vertical well pipe, (e) an annular recess in said top surface around said vertical opening, (f) said recess having an outer defining wall portion leading downwardly from said top surface, a bottom defining wall portion leading radially inwardly from the bottom of said outer defining wall portion and terminating in an inner end short of said inlet opening, and an inclined wall portion leading downwardly from said inner end of said bottom defining wall portion to said vertical inlet opening, (g) second resilient annular sealing means in said recess around said vertical opening arranged for radial sealing engagement with a vertical well pipe, (h) a fitting arranged for securement to a vertical well pipe and having a bottom surface resting freely on the top surface of said head and engageable with said second sealing means, (i) and outlet means in said fitting communicating with said inlet opening, (j) said first sealing means being compressed between said head and a well casing by the weight of a suspended well pipe and pump, (k) said second sealing means being compressed between said fitting and said head by the weight of a suspended well pipe and pump, (l) said second sealing means being of an enlarged cross section relative to the cross section of said recess such that the compression thereof by the weight of a suspended well pipe and pump fills the entirety of said recess including the area defined by said downwardly inclined wall portion for providing a positive radial seal against a well pipe.

* * * * *